US007847141B2

(12) United States Patent
Briot et al.

(10) Patent No.: US 7,847,141 B2
(45) Date of Patent: Dec. 7, 2010

(54) PROCESS FOR IMPROVING GASOLINE CUTS AND CONVERSION INTO GAS OILS

(75) Inventors: Patrick Briot, Pommier de Beaurepaire (FR); Arnaud Baudot, Lyons (FR); Vincent Coupard, Vaulx en Velin (FR); Alain Methivier, Marly le Roi (FR)

(73) Assignee: IFP Energies Nouvelles, Rueil Malmaison Cedex (FR)

( * ) Notice: Subject to any disclaimer, the term of this patent is extended or adjusted under 35 U.S.C. 154(b) by 1359 days.

(21) Appl. No.: 11/144,739

(22) Filed: Jun. 6, 2005

(65) Prior Publication Data

US 2005/0283037 A1 Dec. 22, 2005

(30) Foreign Application Priority Data

Jun. 4, 2004 (FR) ..... 04 06096

(51) Int. Cl.
*C07C 2/00* (2006.01)

(52) U.S. Cl. ..... 585/535; 585/324; 585/326; 585/327; 585/329; 585/330; 585/518; 585/533; 210/651; 210/806

(58) Field of Classification Search ..... 585/324, 585/326, 327, 329, 330, 518, 533, 535; 210/651, 210/806

See application file for complete search history.

(56) References Cited

U.S. PATENT DOCUMENTS 2,388,095 A * 10/1945 Stahly ..... 95/50
6,051,517 A * 4/2000 Funke et al. ..... 502/4
2002/0111521 A1* 8/2002 O'Rear ..... 585/326
2003/0171632 A1 9/2003 DuToit
2004/0033370 A1 2/2004 Chau et al.

FOREIGN PATENT DOCUMENTS

DE 3030998 A1 4/1982
WO WO 96/20988 * 7/1996

* cited by examiner

*Primary Examiner*—Prem C Singh
(74) *Attorney, Agent, or Firm*—Millen, White, Zelano & Branigan, P.C.

(57) ABSTRACT

The invention relates to a process for converting a hydrocarbon charge of linear and branched olefins, comprises the following stages:

a) a stage of membrane separation of the hydrocarbon charge under conditions making it possible to produce a cut β containing the majority of the linear olefins present in said charge, and a cut γ containing the majority of the branched olefins, b) a stage of treatment of the linear olefins contained in the effluents originating from the membrane separation stage (cut β) under moderate oligomerization conditions, c) a stage of distillation separation of the effluents originating from the oligomerization stage into at least two cuts, d) a stage of hydrogenation of the cut η under conditions for obtaining a gas oil with a high cetane number.

25 Claims, 1 Drawing Sheet

PROCESS FOR IMPROVING GASOLINE CUTS AND CONVERSION INTO GAS OILS

FIELD OF THE INVENTION

The present invention relates to a process making it possible simply and economically to modulate the respective productions of gasoline and gas oil. More precisely, according to the process forming the subject of the present application, it is possible to convert an initial charge of hydrocarbons comprising from 4 to 15 carbon atoms, and preferably from 4 to 11 carbon atoms, into a gasoline fraction with an improved octane number relative to that of the charge, and a gas oil fraction with a high cetane number.

It is known (*Carburants et Moteurs,* J. C. Guibet, Edition Technip, Volume 1 (1987)) that the chemical nature of the olefins contained in gasolines contributes greatly to the octane number of said gasolines. The olefins can for this reason be classified into two distinct categories:

a) Branched olefins which possess good octane numbers. This octane number increases with the number of branchings and diminishes with the chain length.

b) Linear olefins which possess a low octane number, this octane number diminishing greatly with the chain length.

The purpose of the present invention is to produce, from a gasoline cut having from 4 to 15 carbon atoms, and preferably from 4 to 11 carbon atoms, a gasoline cut with an improved octane number relative to that of the starting cut, and a gasoline cut with a cetane number at least equal to 35, and preferably greater than 45.

Moreover, the effluents originating from the processes for converting more or less heavy atmospheric distillation residues, or crude oil under vacuum, such as, for example the gasoline cuts originating from the fluidized-bed catalytic cracking (FCC) process, have an olefins content generally comprised between 10 and 80%.

Said effluents feature in the composition of commercial gasolines at a level of 20 to 40% depending on geographical origin (27% in Western Europe and 36% in the USA).

It is probable that, within the framework of protection of the environment, standards relating to commercial gasolines will, in the years to come, be geared towards an increasingly stringent reduction in the olefins content allowed in said gasolines.

From the different points above, it follows that the production of gasolines with a low level of olefins, but preserving an acceptable octane number, can be achieved only by selecting as a base for gasoline, exclusively or in very high proportions, branched olefins with a high octane number.

One of the aims of the present invention is to separate the linear olefins from the branched olefins of an initial gasoline charge.

Another aim of the present invention is to provide a solution allowing increased flexibility of management of the products originating in the refinery.

More precisely, the use of the present process can advantageously make it possible to modulate the gasoline/gas oil proportions obtained leaving the refinery, depending on market requirements.

EXAMINATION OF THE PRIOR ART

Different processes for conversion of olefins making it possible to increase their octane number are known.

For example, there can be mentioned aliphatic alkylation between paraffins and olefins in order to produce gasoline cuts with a high octane number. This process can use mineral acids such as sulphuric acid (Symposium on Hydrogen Transfer in Hydrocarbon Processing, 208th National Meeting, American Chemical Society—August 1994), catalysts soluble in a solvent (EP 0714871) or heterogeneous catalysts (U.S. Pat. No. 4,956,518).

By way of example, the processes of adding alkenes possessing between 2 and 5 carbon atoms to isobutane make it possible to produce highly branched molecules possessing between 7 and 9 carbon atoms, and in general characterized by high octane numbers.

Other conversion processes are known, implementing branched olefin etherification processes, such as for example those described in the patents U.S. Pat. No. 5,633,416 and EP 0451989. These processes make it possible to produce MTBE (methyl tertio butyl ether), ETBE (ethyl tertio butyl ether) and TAME (tertio amyl methyl ether) type ethers, compounds well known for improving the octane number of gasolines.

According to a third route, the oligomerization processes, essentially based on the dimerization and trimerization of light olefins generally originating from the catalytic cracking process and possessing between 2 and 4 carbon atoms, allow the production of gasoline cuts or distillates.

For example, the process described in the patent EP 0734766 makes it possible to obtain chiefly products having 6 carbon atoms when the olefin used is propylene, and 8 carbon atoms when the olefin is linear butene.

These oligomerization processes are well known for producing gasoline cuts possessing good octane numbers, but when they are produced under conditions favouring the formation of heavier cuts, they generate gas oil cuts with a very low cetane number. Such examples are moreover illustrated by the patents U.S. Pat. No. 4,456,779 and U.S. Pat. No. 4,211,640.

The patent U.S. Pat. No. 5,382,705 proposes coupling the oligomerization and etherification processes previously described in order to produce tertiary alkyl ethers such as MTBE or ETBE and lubricants from a $C_4$ cut.

SUMMARY DESCRIPTION OF THE INVENTION

The invention relates to a process for converting a hydrocarbons charge containing from 4 to 15 carbon atoms and preferably from 4 to 11 carbon atoms, and comprising linear and branched olefins, said process comprising the following stages:

a) a stage of membrane separation of the hydrocarbon charge under conditions allowing the selective separation of the majority of the linear olefins present in said charge, the cut containing the majority of the branched olefins constituting a gasoline with a high octane number, i.e. greater than that of the charge, b) a stage of treatment of the linear olefins contained in the effluents originating from the stage of membrane separation under moderate oligomerization conditions, c) a stage of distillation separation of the effluents originating from the oligomerization stage into at least two cuts:
   - a light cut called cut δ, comprising hydrocarbons the final boiling point of which is below a temperature comprised between 150° C. and 200° C.,
   - a heavy cut called cut η, comprising hydrocarbons the initial boiling point of which is above a temperature comprised between 150° C. and 200° C., d) a stage of hydrogenation of the heavy cut η under conditions for obtaining a gas oil with a high cetane number, i.e at least equal to 35 and preferably greater than 45.

According to a first variant of the process, the light cut δ originating from the distillation separation stage and comprising the majority of the linear paraffins and some of the linear olefins is at least in part recycled to the inlet of the oligomerization unit.

According to a second variant of the invention, the light cut δ originating from the distillation separation stage and comprising the majority of the linear paraffins and some of the linear olefins, is at least in part mixed with the effluent from the membrane separation unit containing the majority of the branched olefins.

The oligomerization stage is generally carried out in the presence of a catalyst comprising at least one metal of group VIB of the periodic table.

The stage of separation of the linear olefins and paraffins on the one hand, and branched olefins and paraffins on the other hand, is carried out in a so-called membrane separation unit which can use very different types of membrane, the invention being in no way linked to a particular type of membrane.

The membranes which can be used within the framework of the invention are preferably membranes used in nanofiltration and reverse osmosis (membranes within the category of membranes for filtration processes) or membranes used in gas phase permeation or pervaporation (membranes within the category of membranes for permeation or pervaporation processes).

From the materials point of view, these membranes can be either zeolite-type membranes, or polymer (or organic) type membranes, or also ceramic (or mineral) type membranes, or also of composite type in the sense that they can be constituted by a polymer and at least one mineral compound.

The membranes which can be used in the process forming the subject of the invention can also be film-based. For example there can be mentioned in this latter category film-based membranes formed from a molecular sieve or the film-based membranes formed from a molecular sieve of the silicates, aluminosilicates, aluminophosphates, silicoaluminophosphates, metalloaluminophosphates, stanosilicates types, or a mixture of at least one of these two types of constituents.

As regards zeolites-based membranes, there can more particularly be mentioned zeolites-based membranes of MFI or ZSM-5 type, native or having been exchanged with H+, Na+, K+, Cs+, Ca+, Ba+ ions, and LTA-type zeolites-based membranes.

In certain cases, the process according to the invention can comprise a stage of elimination of at least some of the nitrogenous or basic impurities contained in the initial hydrocarbons charge, said purification stage being situated upstream of the membrane separation stage.

Generally, the initial hydrocarbon charge will originate from a catalytic cracking, thermal cracking or paraffins-dehydrogenation process. It can be processed separately or in mixture with other charges whilst taking account of the fact that the resultant mixture will have a number of carbon atoms always comprised between 4 and 15 carbon atoms and preferably comprised between 4 and 11 carbon atoms.

An example of a charge which can be mixed with the starting charge is the gasoline cut from direct distillation of crude oil with a final boiling point generally close to 200° C.

BRIEF SUMMARY OF DRAWING

The invention will be better understood on reading FIG. 1 which corresponds to the process diagram according to the invention.

DETAILED DESCRIPTION OF THE INVENTION

Figure 1:
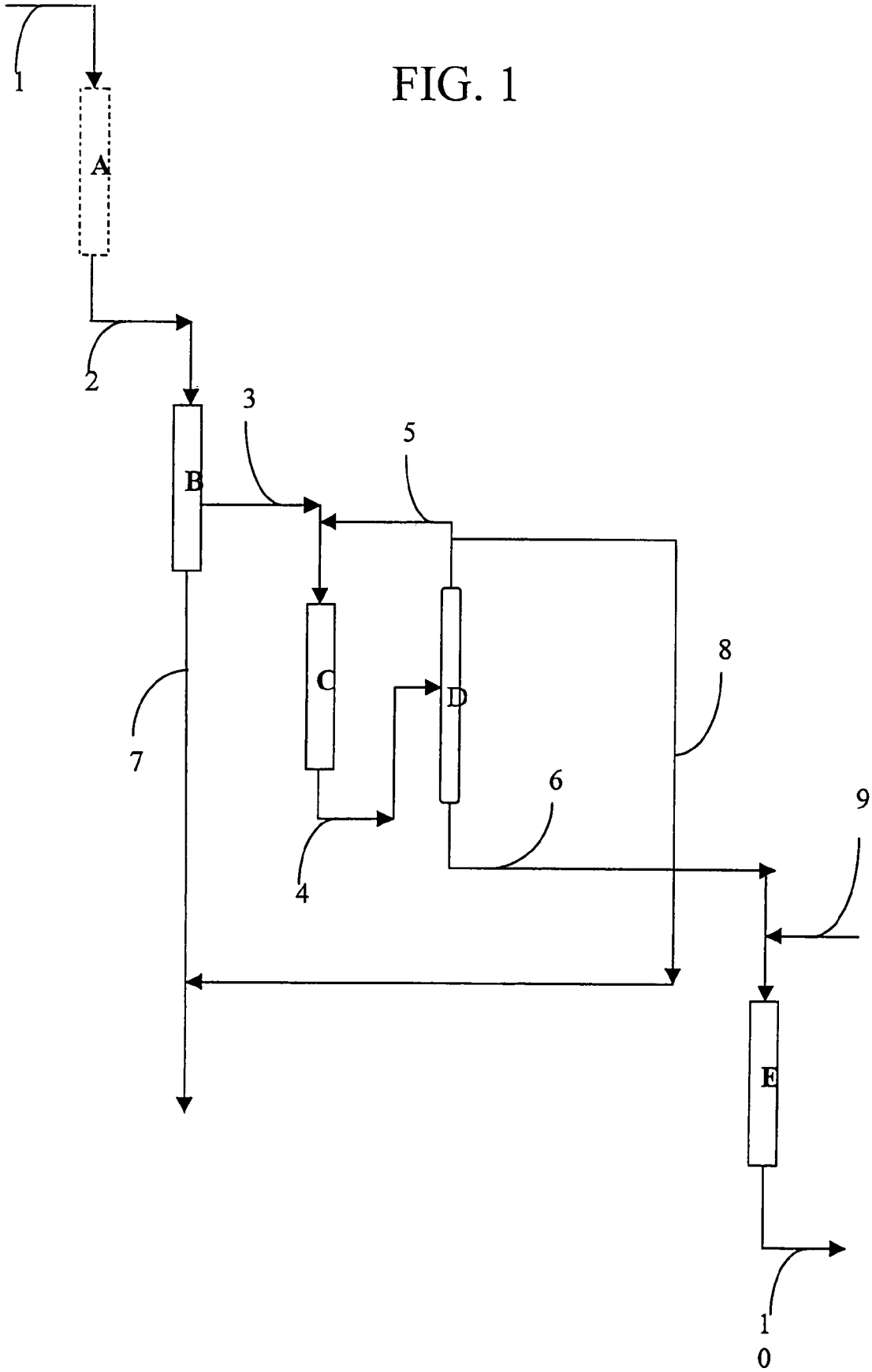
FIG. 1 represents a diagram of the process according to the invention comprising a charge purification unit A which is optional, a membrane separation unit B, an oligomerization unit C and a distillation or flash separation unit D and a hydrogenation unit E.

According to FIG. 1, the hydrocarbon charge is conveyed through the line 1 to a purification unit A.

This unit A makes it possible to eliminate a large part of the nitrogenous and/or basic compounds contained in the charge. This elimination, although optional, is necessary when the hydrocarbon charge comprises a high level of nitrogenous and/or basic compounds, as the latter constitute a poison for the catalysts of the following stages of the present process.

Said compounds can be eliminated by adsorption on an acid solid. This solid can be chosen from the group formed by the silicoaluminates, the titanosilicates, mixed alumina titanium oxides, clays, resins.

The solid can also be chosen from the mixed oxides obtained by grafting at least one organometallic, organosoluble or water-soluble compound, of at least one element chosen from the group formed by titanium, zirconium, silicon, germanium, tin, tantalum, niobium, onto at least one oxide support such as alumina (gamma, delta, eta forms, alone or in mixture), silica, alumina silicas, titanium silicas, zirconium silicas, Amberlyst-type ion-exchange resins, or any other solid having any acidity whatever. A particular embodiment of the invention can consist of utilizing a mixture of at least two of the catalysts previously described.

The pressure of the charge purification unit is comprised between atmospheric pressure and 10 MPa, preferably between atmospheric pressure and 5 MPa, and a pressure below which the charge is found in liquid state will preferably be chosen. The ratio of charge volume flow rate to catalytic solid volume (called HSV [hourly space velocity]) is most often comprised between 0.05 litre/litre.hour and 50 litres/litre.hour, and preferably comprised between 0.1 litre/litre.hour and 20 litres/litre.hour, and still more preferably between 0.2 litre/litre.hour and 10 litres/litre.hour.

The temperature of the purification unit is comprised between 15° C. and 300° C., preferably between 15° C. and 150° C., and very preferably between 15° C. and 60° C.

The elimination of the nitrogenous and/or basic compounds contained in the charge can also be carried out by washing with an acid aqueous solution, or by any other equivalent means known to a person skilled in the art.

The purified charge called cut α is conveyed through the line 2 towards the membrane separation unit B. In the unit B, the linear and branched olefins forming the cut β are separated on a membrane from the remainder of the gasoline cut and are removed through the line 3 in order to feed an oligomerization unit C.

The cut no longer containing linear olefins and paraffins is removed from the unit B through the line 7. This cut, called cut γ, the olefins content of which has fallen noticeably since it now contains only the branched olefins, possesses an improved octane number relative to the initial gasoline cut.

The membrane separation stage carried out in the unit B can utilize any type of membrane such as those used in the nanofiltration or reverse osmosis processes, or also in the gas-phase permeation or pervaporation processes.

More precisely, any type of membrane making it possible to carry out the separation between the linear paraffins and olefins and the branched paraffins and olefins can be used, be they organic or polymer membranes (for example, the PDMS 1060 membrane from Sulzer Chemtech Membrane Systems), ceramic or mineral membranes (composed at least in part for example of zeolite, silica, alumina, glass or carbon), or composites constituted by polymer and at least one mineral or ceramic compound (for example the PDMS 1070 membrane from Sulzer Chemtech Membrane Systems).

Numerous works in the literature refer to film-based membranes formed from molecular sieve, such as MFI-type zeolites, which make it possible to separate linear paraffins from branched paraffins very efficiently by means of a diffusional selectivity mechanism.

All the MFI zeolites-based types of membrane, be they silicalite-based, or completely dealuminified MFI zeolites-based membranes, have a normal/isoparaffins selectivity and can therefore be used within the framework of the present invention.

Among the MFI-type zeolites, there can be mentioned those described in the following articles or communications:

van de Graaf, J. M., van der Bijl, E., Stol, A., Kapteijn, F., Moulijn, J. A., in *Industrial Engineering Chemistry Research,* 37, 1998, 4071-4083.

Gora, L., Nishiyama, N., Jansen, J. C., Kapteijn, F., Teplyakov, V., Maschmeyer, Th., in *Separation Purification Theology,* 22-23, 2001, 223-229;

Nishiyama, N., Gora, L., Teplyakov, V., Kapteijn, F., Moulijn, J. A., in *Separation Purification Theology,* 22-23, 2001, 295-307;

Among the native ZSM-5 zeolites-based membranes, there can be cited the following communications:

Coronas, J., Falconer, J. L., Noble, R. D., in *AIChE Journal,* 43, 1997, 1797-1812;

Gump, C. J., Lin, X., Falconer, J. L., Noble, R. D., in *Journal of Membrane Science,* 173, 2000, 35-52.

Finally among the membranes having been exchanged with ions of type H+, Na+, K+, Cs+, Ca+ or Ba+ type ions, there can be cited Aoki, K., Ruan, V. A., Falconer, J. L., Noble, R. D., in *Microporous Mesoporous Materials,* 39, 2000, 485-492.

The published values for mixed n-C4/i-C4 selectivity, obtained with this type of membrane, vary between 10 and 50 depending on the operating conditions. On this point the publication van de Graaf, J. M., van der Bijl, E., Stol, A., Kapteijn, F., Moulijn. J. A., in *Industrial Engineering Chemistry Research,* 37, 1998, 4071-4083 can be consulted.

The separation selectivities observed with MFI zeolites-based membranes applied to n-hexane/dimethylbutane separation are still higher:

200 to 400 as mentioned in the publication of Coronas, J., Noble, R. D., Falconer, J. L., in Ind. Eng. Chem. Res. 37, 1998, 166-176, from 100 to 700 (Gump, C. J., Noble, R. D., Falconer, J. L., in Ind. Eng. Chem. Res., 38, 1999, 2775-2781, from 600 to more than 2000 (Keizer, K., Burggraaf, A. J., Vroon, Z. A. E. P, Verweij, H., in *Journal of Membrane Science,* 147, 1998, 159-172.

The selectivity of this type of membrane is essentially based on a difference in diffusivity between the linear compounds, diffusing more rapidly, as they offer an appreciably smaller kinetic diameter than the diameter of the micropores of the zeolite, and the branched compounds, diffusing more slowly, as they have a kinetic diameter close to that of the micropores.

The paraffins and their branched or linear olefinic homologues having a very close kinetic diameter, the MFI zeolites-based membranes finally offer high normal/iso-olefin selectivities, close to those observed for the normal/iso-paraffins under similar operating conditions.

It is also possible to envisage using membranes based on a zeolite of LTA structural type, a zeolite which possesses a very good form selectivity vis-à-vis normal paraffins.

The operating temperature of the membrane will be comprised between ambient temperature and 400° C., and preferably between 80° C. and 300° C. The linear olefins and paraffins (cut β) separated from the gasoline cut in the unit B, are sent into an oligomerization reactor, represented by the unit C, by means of the line 3. This unit C contains an acid catalyst. The hydrocarbons present in the mixture of linear paraffins and olefins undergo moderate oligomerization reactions, i.e. in general dimerizations or trimerizations, the reaction conditions being optimized for the production of a majority of hydrocarbons the carbon number of which is comprised between 9 and 25, and preferably between 10 and 20.

The catalyst of the unit C can be chosen from the group formed by the silicoaluminates, titanosilicates, alumina titanium mixtures, clays, resins, mixed oxides obtained by grafting of at least one organometallic, organosoluble or water-soluble compound, (chosen from the group formed by the alkyl metals and/or the alkoxy metals having at least one element such as titanium, zirconium, silicon, germanium, tin, tantalum, niobium) on an oxide support such as alumina (gamma, delta, eta forms, alone or in mixture), silica, the alumina silicas, titanium silicas, zirconium silicas, or any other solid having any acidity whatever.

Preferably, the catalyst used in order to carry out the oligomerization comprises at least one metal of Group VIB of the periodic table, and advantageously an oxide of said metal. Said catalyst can moreover comprise an oxide support chosen from the group formed by the aluminas, titanates, silicas, zirconia, alumino-silicates.

A particular embodiment of the invention consists of utilizing a physical mixture of at least two of the catalysts previously mentioned.

The pressure of the unit C is most often such that the charge is in liquid form.

This pressure is in principle comprised between 0.2 MPa and 10 MPa, preferably between 0.3 MPa and 6 MPa, and still more preferably between 0.3 MPa and 4 MPa. The ratio of charge volume flow rate to catalyst volume (also called HSV [hourly space velocity]) can be comprised between 0.05 litre/litre.hour and 50 litres/litre.hour, preferably between 0.1 litre/litre.hour and 20 litres/litre.hour, and still more preferably between 0.2 litre/litre.hour and 10 litres/litre.hour.

It has been found by the Applicant that, under the preceding pressure and HSV conditions, the reaction temperature had to be comprised between 15° C. and 300° C., preferably between 60° C. and 250° C., and more particularly between 100° C. and 250° C. in order to optimize the quality of the products finally obtained.

The effluent originating from the unit C is then sent via the line 4 into one or more distillation columns represented in the diagram by the unit D. This unit D can also be a flash flask or any other means known to a person skilled in the art making it possible to separate the effluents into at least two distinct cuts by their boiling point:

a so-called light cut δ, the final distillation point of which is comprised between approximately 150° C. and approximately 200° C., preferably between 150° C. and 180° C. This cut can be wholly or partially recycled to the inlet of the unit C through the line 5 or wholly or partially mixed with the effluent of the unit B or cut γ, in order to form a gasoline with an improved octane index relative to that of the starting charge.

a so-called heavy cut η, the final distillation point of which is comprised between approximately 150° C. and approximately 200° C., preferably between 150° C. and 180° C. This cut is conveyed through the line 6 to the unit E.

The heavy cut η is a cut the initial point of which corresponds to a gas oil cut. This cut can be hydrogenated in a standard hydrogenation unit E in the presence of a catalyst and under operating conditions well known to a person skilled in the art. The effluent of the unit E constitutes a gas oil with a cetane number greater than 35, and preferably greater than 45.

EXAMPLES

The examples which follow make it possible to illustrate the advantages associated with the present invention.

Example 1 is according to the invention and will be better understood by following the diagram in FIG. 1.

Example 2 is a comparative example.

Examples 1 and 2 have in common the units A, C, D and E. The only difference is that Example 2 does not comprise the membrane separation unit B.

Example 1 (According to the Invention)

In this example, the charge is an FCC gasoline with a boiling point comprised between 40° C. and 150° C. This gasoline contains 10 ppm of nitrogen.

This charge is sent into a purification reactor A containing a solid constituted by a mixture of 20% alumina and 80% of Mordenite-type zeolite by weight. The zeolite used in the present example possesses a silicon-aluminium ratio of 45.

The pressure of the purification unit is 0.2 MPa.

The ratio of charge volume flow rate to acid solid volume (HSV) is 1 litre/litre.hour.

The temperature of the reactor is 20° C.

Table 1 gives the composition of the initial charge and that of the effluent originating from the unit A. The charge flow rate is 1 kg/h.

TABLE 1

Characteristics of the charge and the effluent from the unit A.

| | Charge of the unit A | Effluent from the unit A (cut α) |
|---|---|---|
| Nitrogen (ppm) | 10 | 0.2 |
| Paraffins (% by weight) | 25.2 | 25.1 |
| Naphthenes (% by weight) | 9.6 | 9.8 |
| Aromatics (% by weight) | 34.9 | 35 |
| Olefins (% by weight) | 30.3 | 30.1 |

The effluent from the unit A is then sent into a membrane reactor B, the membrane being constituted by an alumina-based support α to which a layer of MFI zeolite with a thickness comprised between 5 and 15 μm is applied.

The pressure of the membrane reactor is equal to 1 bar (0.1 MPa) and the temperature to 150° C.

Table 2 gives the composition of the effluents originating from the unit B (cut β; γ).

TABLE 2

Characteristics of the effluents from the unit B.

| | Cut β | Cut γ |
|---|---|---|
| Yield (%) (relative to the cut α) | 8.8 | 91.2 |
| Production (g/h) | 88 | 912 |

TABLE 2-continued

Characteristics of the effluents from the unit B.

| | Cut β | Cut γ |
|---|---|---|
| Paraffins (% by weight) | 45.5 | 23.1 |
| Naphthenes (% by weight) | | 10.7 |
| Aromatics (% by weight) | | 38.5 |
| Olefins (% by weight) | 54.5 | 27.7 |

The cut β originating from the membrane separation unit B is introduced into an oligomerization reactor C containing a catalyst constituted by a mixture of 50% by weight zirconium and 50% by weight $H_3PW_{12}O_{40}$.

The pressure of the oligomerization unit C is 2 MPa, the ratio of charge volume flow rate to catalyst volume is equal to 1.5 litres/litre.hour. The temperature is fixed at 170° C.

At the outlet from the unit C an effluent is obtained which is then separated into 2 cuts in a distillation column D: a light cut δ and a heavy cut η the compositions and yields of which are given in Table 3 below:

TABLE 3

Production and composition of the cuts δ and η.

| | Cut δ | Cut η |
|---|---|---|
| Production (g/h) | 39.6 | 48 |
| Paraffins (%) | 100 | |
| Olefins (%) | | 100 |

The heavy cut η is sent into a hydrogenation reactor E containing a catalyst comprising an alumina support on to which nickel and molybdenum (marketed by AXENS under the trade name HR 348, registered mark) are deposited The pressure of the unit is 5 MPa.

The ratio of charge volume flow rate to catalyst volume is equal to 2 litres/litre.hour.

The ratio of injected hydrogen volume flow rate to charge volume flow rate is equal to 600 litres/litre. The temperature of the reactor is 320° C. The characteristics of the effluent originating from the stage E are presented in Table 4.

TABLE 4

Characteristics of the effluent originating from the unit E

| | Effluent from the unit E |
|---|---|
| Density at 20° C. (kg/l) | 0.787 |
| Sulphur (ppm) | 1 |
| Engine cetane | 55 |

The light cut δ having the distillation range 40° C.-200° C. originating from the unit D is mixed with the cut γ originating from the unit B. The properties of the mixture of the cuts γ and δ are presented in Table 5 and compared to those of the starting cut α.

TABLE 5

Comparison of the characteristics of the initial cut α and the final cut γ + δ

| | Cut α | Cuts γ + δ |
|---|---|---|
| Production (g/h) | 1000 | 951.6 |
| Paraffins (% by weight) | 25.2 | 26.2 |
| Naphthenes (% by weight) | 9.6 | 10 |

TABLE 5-continued

| Comparison of the characteristics of the initial cut α and the final cut γ + δ | | |
|---|---|---|
| | Cut α | Cuts γ + δ |
| Aromatics (% by weight) | 34.9 | 36.2 |
| Olefins (% by weight) | 30.3 | 26.5 |
| RON octane number | 92 | 96 |

The present process makes it possible to obtain, starting with a gasoline cut originating from an FCC unit, a gasoline cut (cut γ +δ) having an improved octane number relative to the initial cut (96 as opposed to 92) and a gas oil cut, effluent from the unit E, with a high cetane number (55), compatible with marketing to European and US specifications.

Example 2 According to the Prior Art

This example corresponds to the prior art and consists of sending a gasoline cut directly to an oligomerization unit after purification, without prior separation of the linear and branched olefins. The effluents originating from the oligomerization unit are separated into a light cut and a heavy cut, designated δ' and η' respectively.

In this example, Stage A is a stage of purification of the charge identical to that of Example 1 according to the invention. The effluent from Stage A is sent to the oligomerization Stage C without passing through the membrane separation Stage B. i.e. without separating the linear and branched olefins. The catalyst used and the operating conditions of Stage C are identical to those of Example 1 according to the invention.

At the end of oligomerization Stage C, the effluent from Stage C is separated into 2 cuts in a distillation column D identical to that of Example 1:

a light cut δ' having the distillation range 40° C.-200° C. with a yield by weight of 70%, a heavy cut η' comprising hydrocarbons the initial distillation point of which is higher than 200° C. with a yield by weight of 30%.

The heavy cut η' is sent into a hydrogenation reactor E containing an alumina-based catalyst to which nickel and molybdenum are applied.

The pressure of the unit of Stage E is 5 MPa, the ratio of charge flow rate to catalyst volume is equal to 2 litres/litre.hour.

The ratio of injected hydrogen flow rate to charge flow rate is equal to 600 litres/litre.

The temperature of the reactor is 320° C.

The characteristics of the effluent originating from the stage E which has the characteristics of a gas oil are presented in Table 6.

TABLE 6

| Characteristics of the effluent originating from the unit E | |
|---|---|
| | Effluent from Stage E |
| Density at 20° C. (kg/l) | 0.787 |
| Sulphur (ppm) | 1 |
| Engine cetane number | 35 |

It is noted that the cetane number of the gas oil obtained when oligomerization is carried out without previously separating the linear compounds from the branched compounds is distinctly lower than that obtained in Example 1 according to the invention. The gas oil of Example 2 according to the prior art is unsuitable for marketing, which is not the case for that obtained in Example 1 according to the invention.

Similarly, the final gasoline cut η' possesses an octane number lower than that obtained in Example 1 according to the invention, which can make its marketing problematical.

The properties of this gasoline cut η' are compared with those of the initial gasoline cut (cut α) in Table 7 below.

TABLE 7

| Compared characteristics of the cuts α and η' | | |
|---|---|---|
| | Cut α | Cut η' |
| Production (g/l) | 1000 | 700 |
| Paraffins (% by weight) | 25.2 | 36.2 |
| Naphthenes (% by weight) | 9.6 | 13.7 |
| Aromatics (% by weight) | 34.9 | 50.1 |
| Olefins (% by weight) | 30.3 | |
| RON octane number | 92 | 85 |

The invention claimed is:

1. A process for converting a hydrocarbons charge comprising paraffins, and linear and branched olefins comprising from 4 to 15 carbon atoms, said process comprising the following stages:

a) a stage of membrane separation of the hydrocarbon charge, wherein the membrane separation stage comprises a membrane based on zeolites of MFI or ZSM-5 type, native or having been exchanged with H+, Na+, K+, Cs+, Ca+, Ba+ ions at ambient temperature to 400° C. and under conditions making it possible to produce a cut β containing paraffins and a majority of the linear olefins present in said charge, and a cut β containing paraffins and a majority of the branched olefins constituting a gasoline with a high octane number, greater than that of the charge, b) an oligomerization stage of treatment of the linear olefins contained in cut β under moderate oligomerization conditions comprising a pressure between 0.2 and 10 MPa, a ratio of charge volume flow rate to the catalyst volume (HSV) between 0.05 liter/liter.hour and 50 liter/liter.hour, and a temperature between 15° C. and 300° C., c) a stage of distillation separation of effluents from the oligomerization stage into at least two cuts a light cut δ, comprising hydrocarbons having a final boiling point below a temperature of between 150° C. and 200° C., and comprising the majority of the linear olefins and partly recycling said light cut δ to the oligomerization stage, and partly mixing said light cut δ with said cut γ containing paraffins and the majority of the branched olefins from the membrane stage, a heavy cut η, comprising hydrocarbons having an initial boiling point above a temperature of between 150° C. and 200° C., d) a stage of hydrogenation of the cut η under conditions for obtaining a gas oil with a cetane number of at least 35.

2. A process according to claim 1 wherein the oligomerization stage is carried out in the presence of an acid catalyst comprising at least one metal of group VIB of the periodic table.

3. A process according to claim 1 further comprising a stage of elimination of at least some of the nitrogenous or basic impurities contained in the hydrocarbons charge, said purification stage being situated upstream of the membrane separation stage.

4. A process according to claim 1 wherein the initial hydrocarbons charge originates from a catalytic cracking, thermal cracking or paraffins-dehydrogenation process.

5. A process according to claim 1 wherein the hydrocarbon charge contains linear and branched olefins consisting of 4 to 15 carbon atoms.

6. A process according to claim 1 wherein the resultant gas oil of stage (d) has a cetane number greater than 45.

7. A process according to claim 1 wherein said pressure is between 0.3 and 6 Mpa, the ratio of charge volume flow rate to catalyst volume (HSV) is between 0.05 liter/liter-hour and 20 liters/liter-hours and the temperature is between 60 and 250° C.

8. A process according to claim 1 wherein said pressure is between 0.3 and 4 Mpa, the ratio of charge volume flow rate to catalyst volume (HSV) is between 0.2 liter/liter-hour and 10 liters/liter-hours and the temperature is between 100 and 250° C.

9. A process according to claim 1 wherein the temperature is between 80 and 300°.

10. A process according to claim 8 wherein the temperature is between 80 and 300° C.

11. Process A process according to claim 10 wherein the oligomerization stage is carried out in the presence of an acid catalyst comprising at least one metal of group VIB of the periodic table.

12. A process according to claim 1 wherein the olefins in the light cut are substantially only branched olefins.

13. A process according to claim 1 wherein the olefins in the light cut are only branched olefins.

14. A process according to claim 1, wherein the charge is a gasoline.

15. A process according to claim 1, wherein the charge consists essentially of a gasoline from a fluidized catalytic cracking process.

16. A process for converting a hydrocarbon charge comprising paraffins, and linear and branched olefins comprising from 4 to 15 carbon atoms, said process comprising the following stages:

a) a stage of membrane separation of the hydrocarbon charge at ambient temperature to 400° C. and under conditions making it possible to produce a cut β containing paraffins and a majority of the linear olefins present in said charge, and a cut γ containing paraffins and a majority of the branched olefins constituting a gasoline with a high octane number, greater than that of the charge, b) an oligomerization stage of treatment of the linear olefins contained in cut β under moderate oligomerization conditions comprising a pressure between 0.2 and 10 MPa, a ratio of charge volume flow rate to the catalyst volume (HSV) between 0.05 liter/liter.hour and 50 liter/liter.hour, and a temperature between 15° C. and 300° C., c) a stage of distillation separation of effluents from the oligomerization stage into at least two cuts a light cut δ, comprising hydrocarbons having a final boiling point below a temperature of between 150° C. and 200° C., and comprising the majority of the linear olefins and partly recycling said light cut δ to the oligomerization stage, and partly mixing said light cut δ with said cut γ containing the majority of the branched olefin from the membrane stage, a heavy cut η, comprising hydrocarbons having an initial boiling point above a temperature of between 150° C. and 200° C., d) a stage of hydrogenation of the cut η under conditions for obtaining a gas oil with a cetane number of at least 35.

17. A process for converting a gasoline cut comprising a gasoline cut coming from a fluidized catalytic cracking unit (FCC) comprising linear and branched olefins comprising from 4 to 15 carbon atoms, said process comprising the following stages:

a) with a membrane based on zeolite MFI, conducting a stage of membrane separation of the hydrocarbon charge to produce a cut β containing the majority of the linear olefins present in said charge, and a cut γ containing the majority of the branched olefins constituting a gasoline with a high octane number greater than that of the charge, said separation stage operating at a temperature in the range 80° C. to 300° C., b) conducting a stage of catalytic oligomerization of the linear olefins contained in cut β from the membrane separation stage under the following conditions: pressure ranging between 0.3 and 4 MPa, ratio (HSV) of volumetric feed flow rate to catalyst volume (HSV) ranging between 0.2 litres/litre.hour and 10 litres/litre.hour, temperature ranging between 100° C. and 250° C., and a catalyst containing at least one metal belonging to group VIB, c) a stage of separation by distillation of effluents coming from the oligomerization stage into at least two cuts:

a light cut δ, comprising hydrocarbons having a final boiling point below a temperature comprised between 150° C. and 200° C., said cut comprising the majority of the linear olefins, said light cut δ being entirely mixed with the cut γ coming from the membrane separation stage and containing the majority of the branched olefins, and a heavy cut η, comprising the hydrocarbons the initial boiling point of which is above a temperature comprised between 150° C. and 200° C., d) a stage of hydrogeneration of the cut η under conditions for obtaining a gas oil with a cetane number of at least 35.

18. A process according to claim 17, wherein the oligomerization stage is carried out in the presence of a catalyst comprising at least one metal of group VIB of the periodic table and an oxide of said metal.

19. A process according to claim 17, wherein the membrane separation unit utilizes a membrane based on zeolite MFI having been exchanged with H+, Na+, K+, Cs+, Ca+, Ba+ ions.

20. A process according to claim 17, wherein the δ cut has a final boiling point ranging between 150° C. and 180° C.

21. A process according to claim 17, wherein said gasoline cut has a number of carbon atoms ranging between 4 and 11.

22. A process according to claim 17, wherein said gasoline cut coming from the fluidized catalytic cracking unit is mixed with a gasoline cut coming from a direct distillation of crude petroleum and having a final boiling point close to 200° C.

23. A process according to claim 17, comprising a stage of elimination of at least some of the nitrogenous or basic impurities contained in the initial hydrocarbons charge, this purifications stage being situated upstream of the membrane separation stage.

24. A process according to claim 23, wherein said nitrogenous or basic impurities are removed by adsorption with a solid acid belonging to the group defined by: silicoaluminates, titanosilicates, mixed alumina titanium oxides, clays and resins.

25. A process according to claim 17, wherein said cetane number is at least 45.

* * * * *

UNITED STATES PATENT AND TRADEMARK OFFICE

CERTIFICATE OF CORRECTION

PATENT NO. : 7,847,141 B2
APPLICATION NO. : 11/144739
DATED : December 7, 2010
INVENTOR(S) : Patrick Briot et al.

It is certified that error appears in the above-identified patent and that said Letters Patent is hereby corrected as shown below:

Column 10, line 32 reads: "olefins present in said charge, and a cut β containing"

Should read: --olefins present in said charge, and a cut γ containing--

Signed and Sealed this
Twenty-sixth Day of April, 2011

David J. Kappos

David J. Kappos
*Director of the United States Patent and Trademark Office*